US012180973B1

(12) United States Patent
Chen

(10) Patent No.: US 12,180,973 B1
(45) Date of Patent: Dec. 31, 2024

(54) FAN BLADE INSTALLATION STRUCTURE OF CEILING FAN

(71) Applicant: AIR COOL INDUSTRIAL CO., LTD., Taichung (TW)

(72) Inventor: Ken-Tuan Chen, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 18/537,846

(22) Filed: Dec. 13, 2023

(51) Int. Cl.
*F04D 29/34* (2006.01)
*F04D 25/08* (2006.01)
*F04D 29/38* (2006.01)

(52) U.S. Cl.
CPC ..... *F04D 29/34* (2013.01); *F04D 25/088* (2013.01); *F04D 29/388* (2013.01)

(58) Field of Classification Search
CPC ..... F04D 25/088; F04D 29/34
See application file for complete search history.

(56) References Cited

U.S. PATENT DOCUMENTS 6,059,531 A * 5/2000 Tai ..... F04D 29/34 416/207
7,008,192 B2 * 3/2006 Hidalgo ..... F04D 29/34 416/220 A

* cited by examiner

*Primary Examiner* — Courtney D Heinle
*Assistant Examiner* — John S Hunter, Jr.
(74) *Attorney, Agent, or Firm* — Ying-Ting Chen

(57) ABSTRACT

A fan blade installation structure of a ceiling fan, the ceiling fan has at least one fan blade, at least one socket, and at least one elastic member. The elastic member is fixed to a periphery of the socket. The elastic member has an open end provided with a holding portion corresponding to a blade hole of the fan blade. The holding portion is elastically moved in and out of the socket. The holding portion has a guide surface for guiding the fan blade. The open end of the elastic member further has an operating portion outside the socket for a user to move the elastic member. The fan blade installation structure has the effects of installing and removing the fan blade quickly, easy assembly, and good assembly safety.

5 Claims, 7 Drawing Sheets

FAN BLADE INSTALLATION STRUCTURE OF CEILING FAN

FIELD OF THE INVENTION

The present invention relates to a ceiling fan structure, and more particularly, to a fan blade installation structure of a ceiling fan.

BACKGROUND OF THE INVENTION

A conventional fan blade installation structure of a ceiling fan comprises a groove, a fan blade, and an elastic member. The fan blade has a positioning hole. The elastic member is located in the groove. An elastic end of the elastic member has a protrusion corresponding to the positioning hole of the fan blade. The protrusion has an oblique surface facing outward and corresponding to the fan blade. When the oblique surface is pushed by the fan blade, the protrusion is elastically displaced, allowing the fan blade to be inserted in the groove. When the fan blade is inserted to an appropriate position, the protrusion is engaged in the positioning hole of the fan blade to complete the assembly of the fan blade.

The conventional fan blade installation structure does not have the function of removing the fan blade. The elastic member is disposed in the groove, so a large gap is formed between the groove and the fan blade, which causes the fan blade to vibrate easily. Accordingly, the inventor of the present invention has devoted himself based on his many years of practical experiences to solve these problems.

SUMMARY OF THE INVENTION

The primary object of the present invention is to provide a fan blade installation structure of a ceiling fan, which has the effects of installing and removing fan blades quickly, easy assembly, and good assembly safety.

In order to achieve the above object, a fan blade installation structure of a ceiling fan is provided. The ceiling fan has at least one fan blade, at least one socket, and at least one elastic member. The fan blade has a connecting end. The connecting end of the fan blade is formed with a blade hole. The socket has a space therein. An opening is formed on an outer side of the socket for the connecting end of the fan blade to be inserted into the space via the opening. A bottom of the socket has a through hole corresponding to the blade hole of the fan blade. The elastic member has a closed end and an open end. The closed end of the elastic member is fixed to a periphery of the socket. The open end of the elastic member is provided with a holding portion corresponding to the through hole and the blade hole. The open end of the elastic member elastically leans against the holding portion. The holding portion has a guide surface corresponding to the connecting end of the fan blade. The holding portion is elastically moved in and out of the space via the through hole. The open end of the elastic member further has an operating portion outside the socket for a user to move the open end of the elastic member. When the elastic member is in a normal state, the holding portion and the guide surface are located in the space, the guide surface faces the opening, and the guide surface extends in a direction away from the opening and the through hole for the guide surface to be pushed by the connecting end of the fan blade. When the guide surface of the elastic member is pushed by the fan blade, the holding portion is moved away from the space. When the fan blade is connected to the socket, the holding portion passes through the through hole and is engaged in the blade hole so that the fan blade is secured to the socket. When the user operates the operating portion to move away from the space, the holding portion is moved away from the space.

In the fan blade installation structure of the ceiling fan provided by the present invention, through the arrangement of the closed end, the open end and the holding portion of the elastic member, the gap between the space and the fan blade is extremely small, so as to increase the stability and safety of the fan blade. Through the arrangement of the socket, the fan blade, the blade hole, the elastic member and the holding portion of the elastic member, the present invention has the function of installing and removing the fan blade quickly. Through the operating portion, the user can operate the elastic member below the fan blade, thereby improving the convenience and safety of assembling the fan blade.

DETAILED DESCRIPTION OF THE PREFERRED EMBODIMENTS

Figure 1:
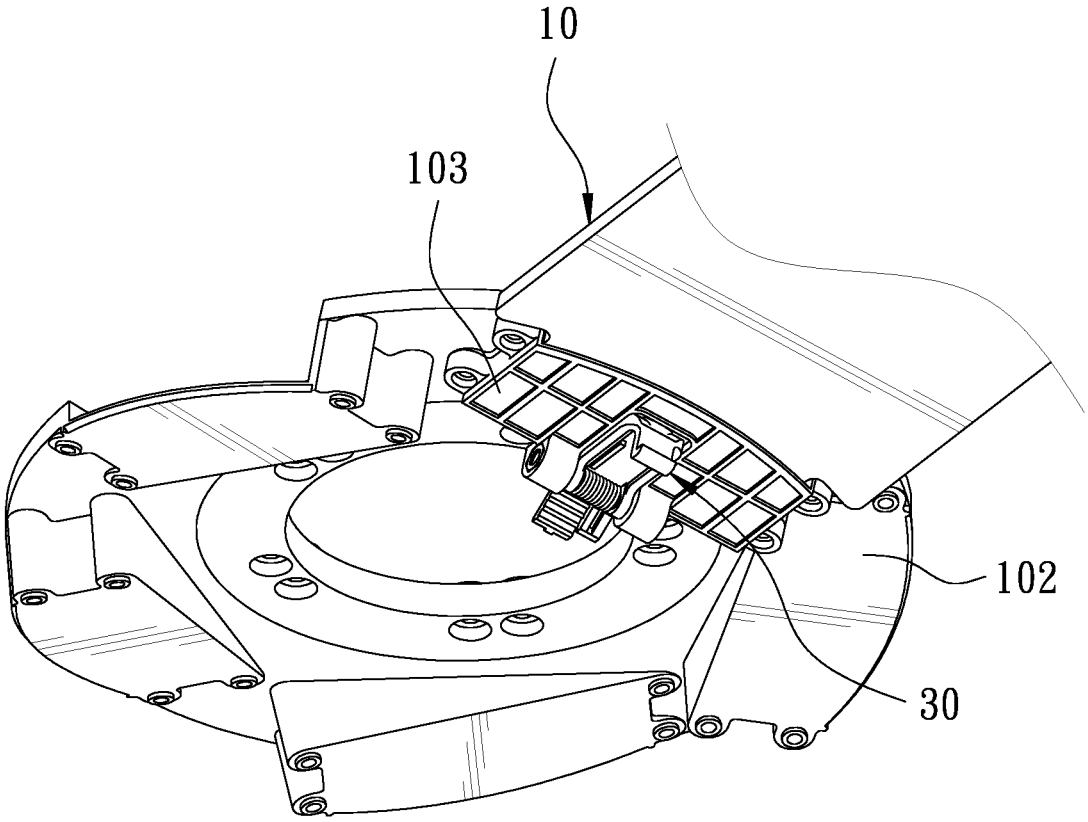
FIG. 1 is a schematic view illustrating the use of the present invention.
Figure 2:
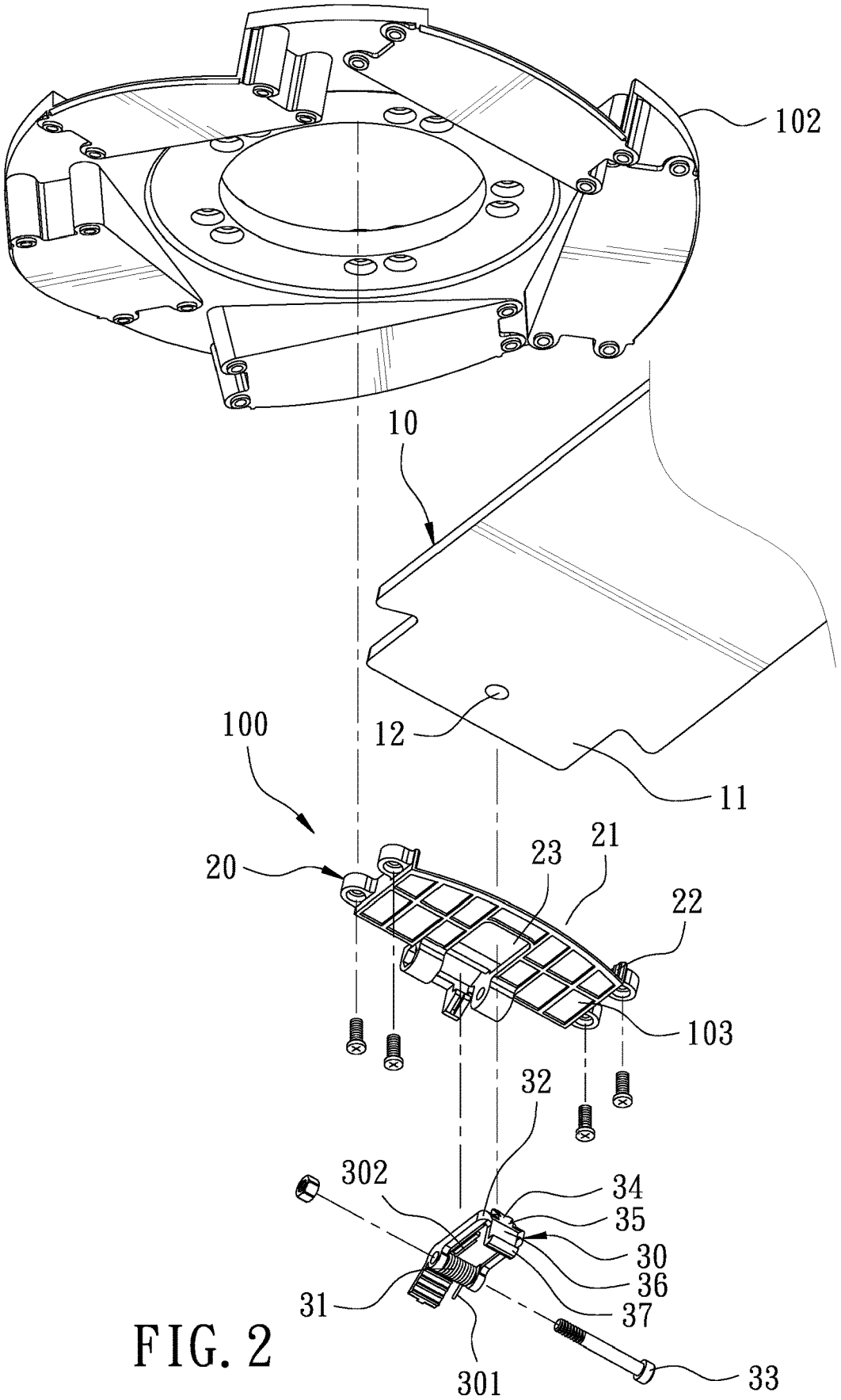
FIG. 2 is an exploded view of the present invention.
Figure 3:
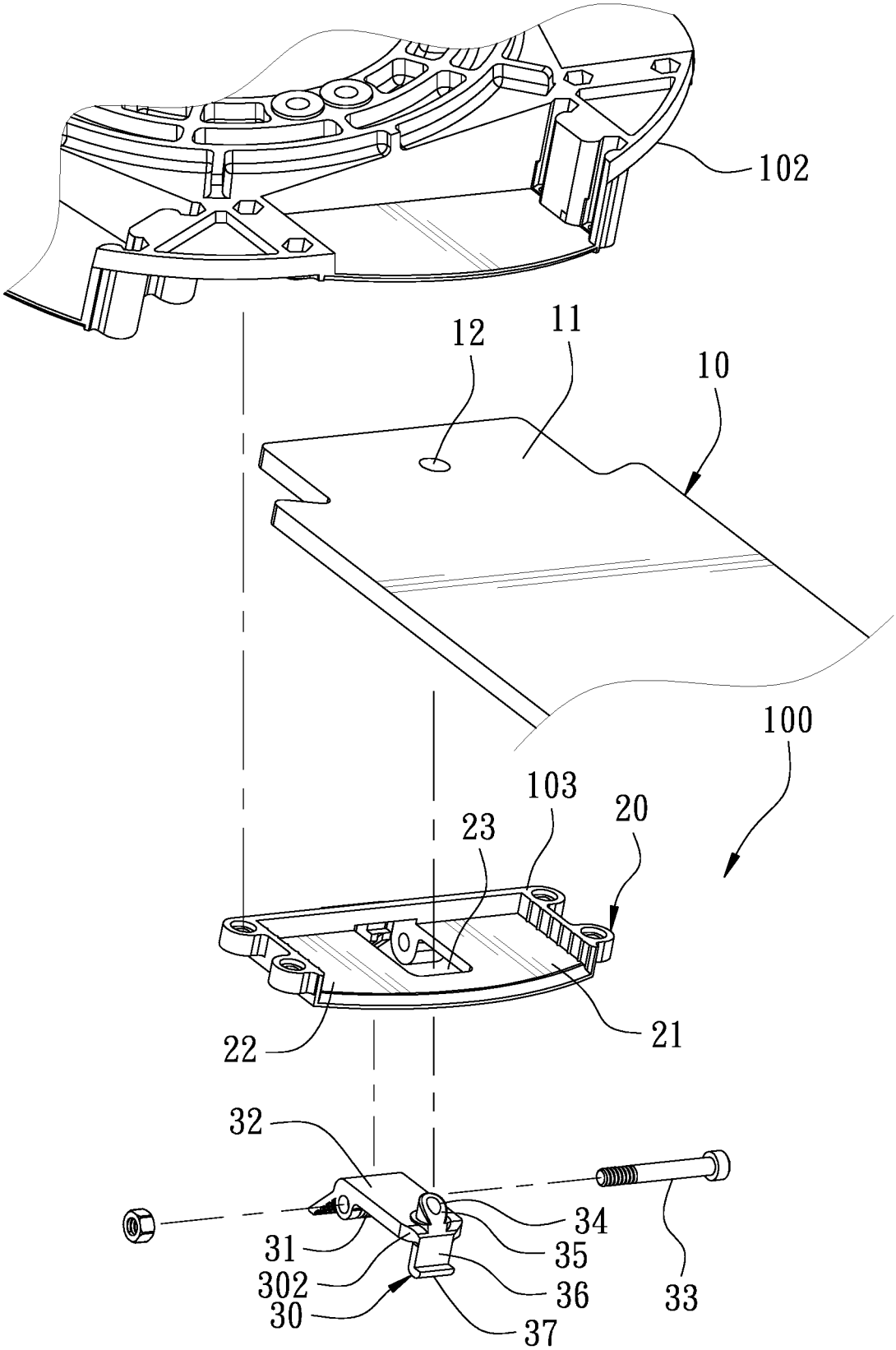
FIG. 3 is another exploded view of the present invention.

Embodiments of the present invention will now be described, by way of example only, with reference to the accompanying drawings.

As shown in FIG. 1 through FIG. 7, the present invention discloses a fan blade installation structure 100 of a ceiling fan 101. The ceiling fan 101 has at least one fan blade 10, at least one socket 20, and at least one elastic member 30. The ceiling fan 101 further has at least one bracket 102, at least one base 103, and a motor 104. The motor 104 has a rotor 105. The rotor 105 is fixedly connected to the at least one bracket 102. The at least one base 103 is fixed below the at least one bracket 102, so that the at least one socket 20 is formed between the at least one base 103 and the at least one bracket 102.

The fan blade 10 has a connecting end 11. The connecting end 11 of the fan blade 10 is formed with a blade hole 12.

The socket 20 has a space 21 therein. An opening 22 is formed on the outer side of the socket 20 for the connecting end 11 of the fan blade 10 to be inserted into the space 21 via the opening 22. The bottom of the socket 20 has a through hole 23 corresponding to the blade hole 12 of the fan blade 10. The through hole 23 is disposed at the bottom of the base 103.

The elastic member 30 has a closed end 301 and an open end 302. The elastic member 30 further has a spring 31, a holding member 32, and a shaft 33. The spring 31 is a torsion spring 31. The spring 31 has the closed end 301 and the open end 302. The base 103, the spring 31 and the holding member 32 are pivotally connected to the shaft 33. The closed end 301 of the elastic member 30 is fixed to the periphery of the socket 20. The closed end 301 of the elastic member 30 is fixedly disposed below the base 103. The closed end 301 of the elastic member 30 is fixed below the base 103. The open end 302 of the elastic member 30 is provided with a holding portion 34 corresponding to the through hole 23 and the blade hole 12. The open end 302 of the elastic member 30 elastically leans against the holding portion 34. The holding member 32 is disposed on one side of the open end 302 of the elastic member 30 adjacent to the through hole 23 so that the open end 302 of the elastic member 30 leans against the holding member 32. The holding member 32 has the holding portion 34 extending toward the space 21. The holding portion 34 has a guide surface 35 corresponding to the connecting end 11 of the fan blade 10. The guide surface 35 is one of a curved surface and an oblique surface. The holding portion 34 is elastically moved in and out of the space 21 via the through hole 23. The open end 302 of the elastic member 30 further has an operating portion 36 outside the socket 20. The holding member 32 extends downward and outward to form the operating portion 36. The operating portion 36 has a flange 37 for the user to move the open end 302 of the elastic member 30 so that the user can operate the elastic member 30 below the fan blade 10. This reduces the difficulty and risk of working at height above the fan blade 10 and improves the convenience and safety of assembling the fan blade. Besides, through the arrangement of the closed end 301, the open end 302 and the holding portion 34 of the elastic member 30, the gap between the space 21 and the fan blade 10 is extremely small, so as to increase the stability and safety of the fan blade 10.

Figure 4:
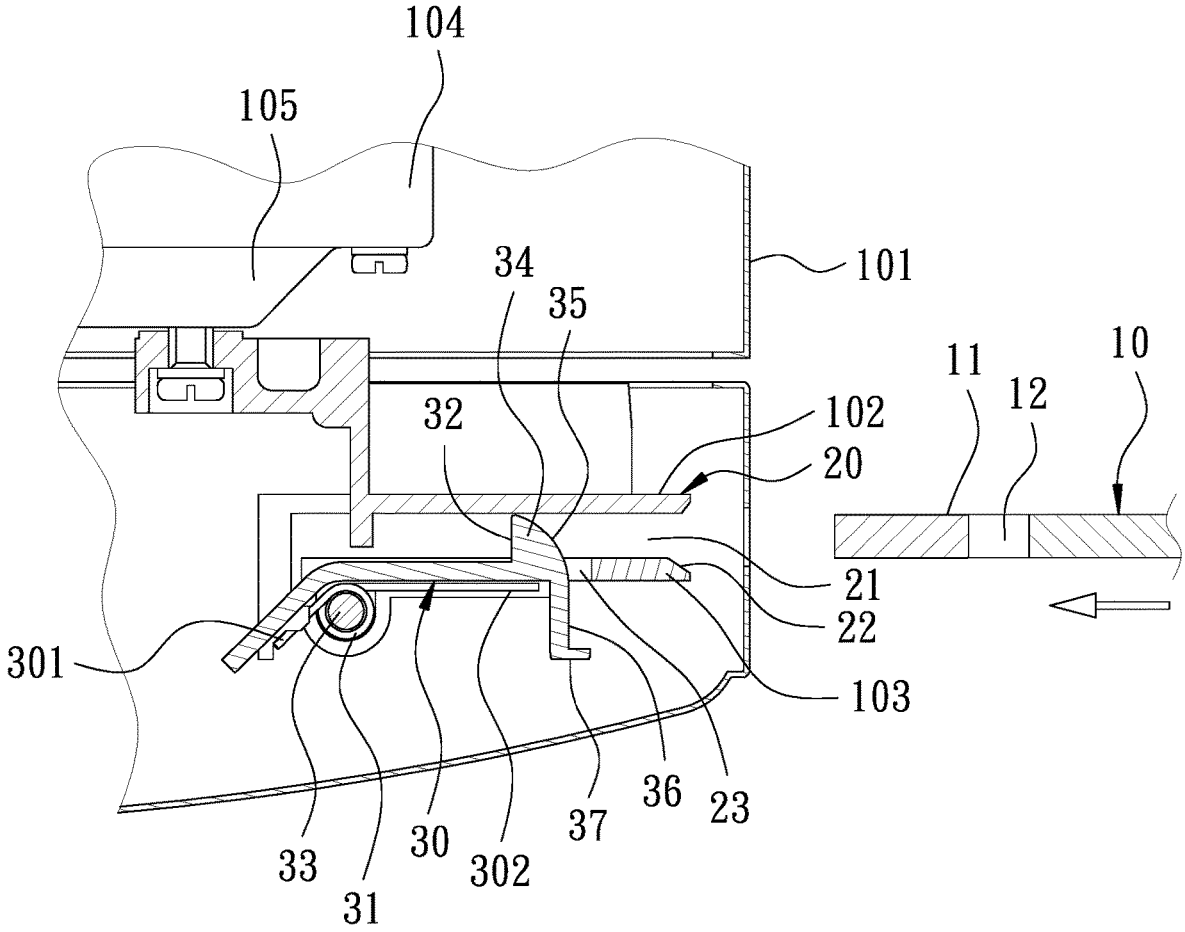
FIG. 4 is a schematic view illustrating the use of the present invention, wherein the fan blade is not inserted in the socket.

As shown in FIG. 4, when the elastic member 30 is in a normal state, the holding portion 34 and the guide surface 35 are located in the space 21. The guide surface 35 faces the opening 22. The guide surface 35 extends in a direction away from the opening 22 and the through hole 23 for the guide surface 35 to be pushed by the connecting end 11 of the fan blade 10.

Figure 5:
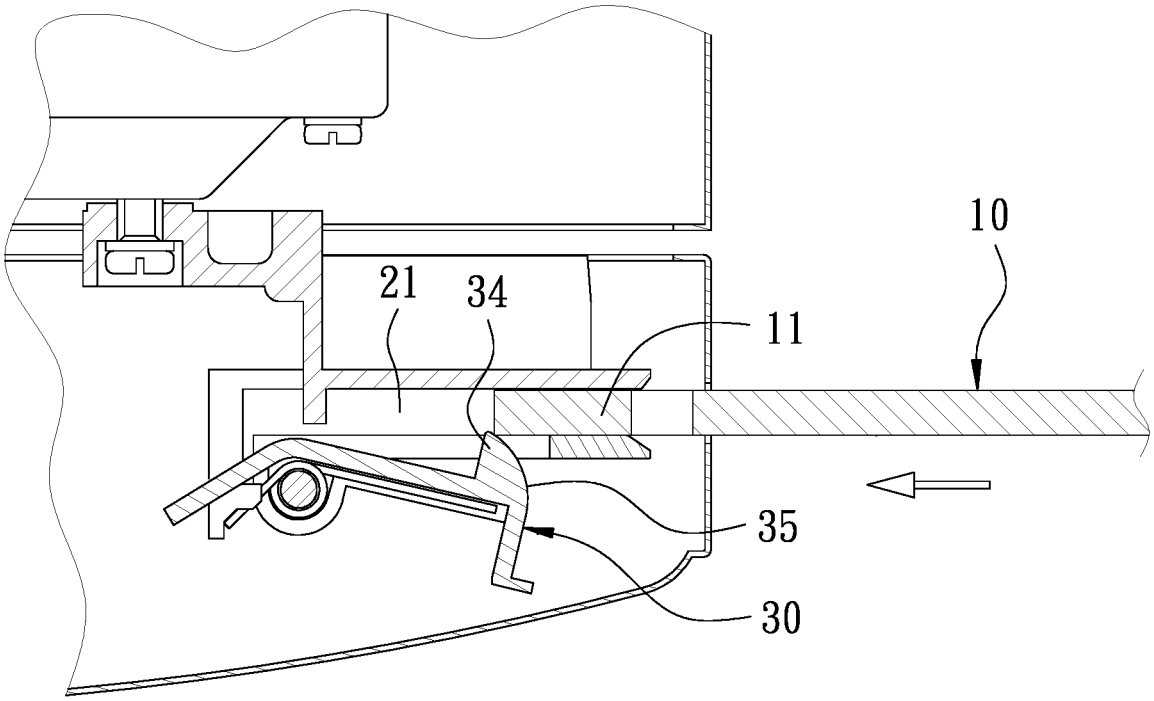
FIG. 5 is a schematic view illustrating the use of the present invention, wherein the fan blade is inserted in the socket.

As shown in FIG. 5, when the guide surface 35 of the elastic member 30 is pushed by the fan blade 10, the holding portion 34 is moved away from the space 21, allowing the connecting end 11 of the fan blade 10 to be fully inserted in the space 21.

Figure 6:
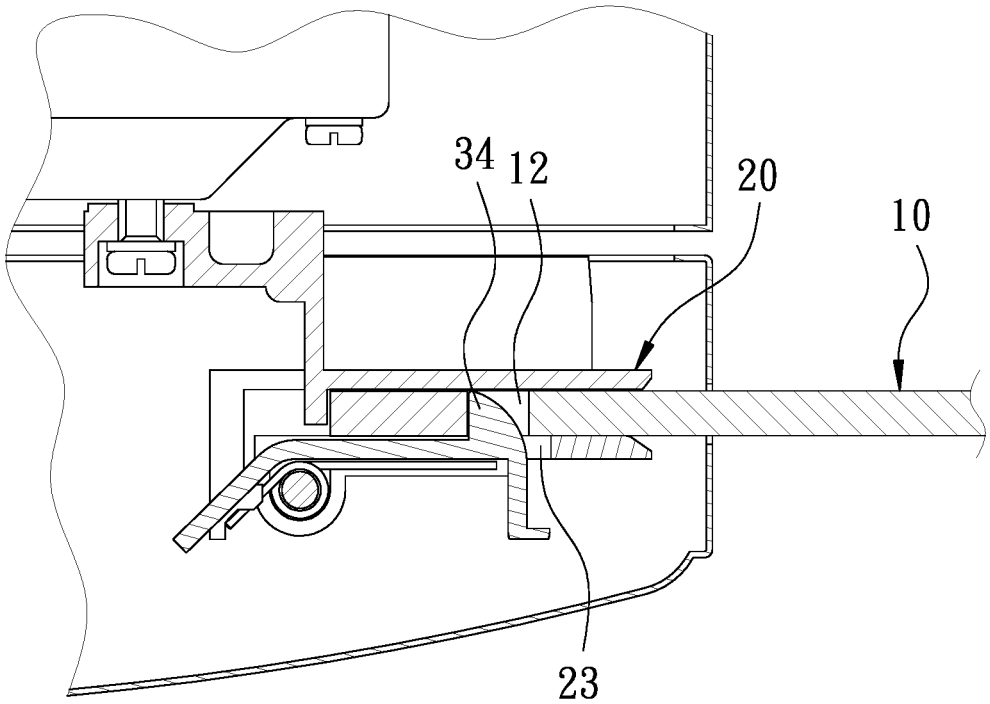
FIG. 6 is a schematic view illustrating the use of the present invention, wherein the fan blade is secured to the socket.

As shown in FIG. 6, when the fan blade 10 is connected to the socket 20, the holding portion 34 passes through the through hole 23 and is engaged in the blade hole 12 so that the fan blade 10 is secured to the socket 20.

Figure 7:
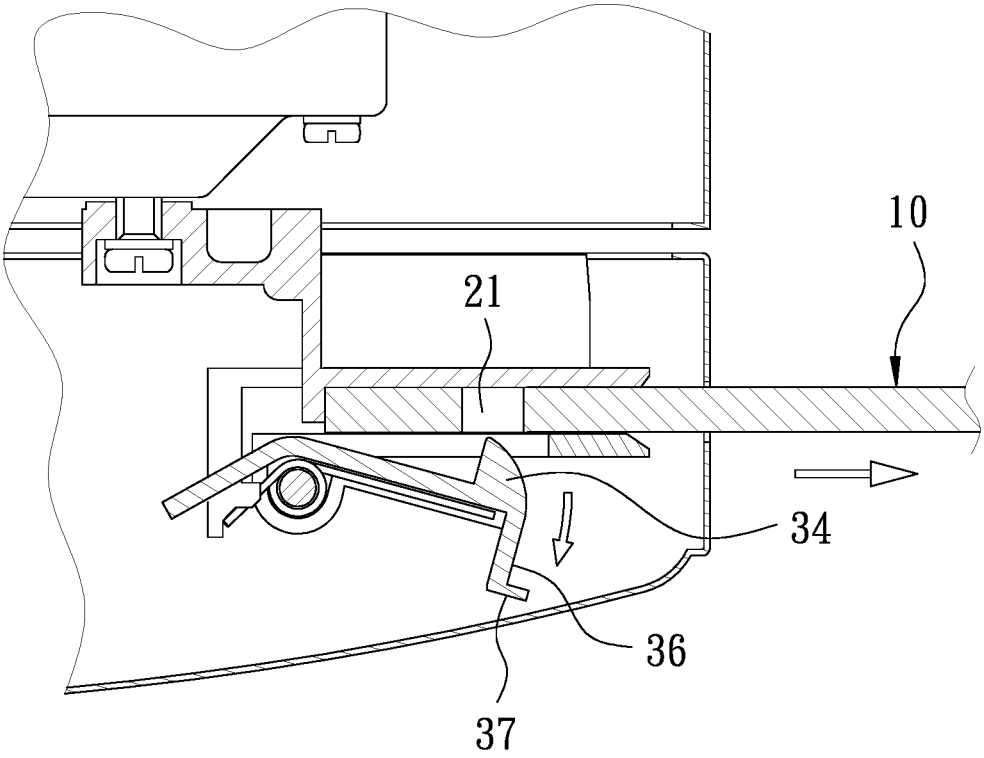
FIG. 7 is a schematic view illustrating the use of the present invention, wherein the fan blade is to be disengaged from the socket.

As shown in FIG. 7, when the user operates the operating portion 36 to move away from the space 21, the holding portion 34 is moved away from the space 21, allowing the fan blade 10 to leave the space 21.

Through the arrangement of the socket 20, the fan blade 10, the blade hole 12, the elastic member 30 and the holding portion 34 of the elastic member 30, the present invention has the function of installing and removing the fan blade quickly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A fan blade installation structure of a ceiling fan, the ceiling fan having at least one fan blade, at least one socket and at least one elastic member;

the fan blade having a connecting end, the connecting end of the fan blade being formed with a blade hole;

the socket having a space therein, an opening being formed on an outer side of the socket for the connecting end of the fan blade to be inserted into the space via the opening, a bottom of the socket having a through hole corresponding to the blade hole of the fan blade;

the elastic member having a closed end and an open end, the closed end of the elastic member being fixed to a periphery of the socket, the open end of the elastic member being provided with a holding portion corresponding to the through hole and the blade hole, the open end of the elastic member elastically leaning against the holding portion, the holding portion having a guide surface corresponding to the connecting end of the fan blade, the holding portion being elastically moved in and out of the space via the through hole, the open end of the elastic member further having an operating portion outside the socket for a user to move the open end of the elastic member; wherein when the elastic member is in a normal state, the holding portion and the guide surface are located in the space, the guide surface faces the opening, and the guide surface extends in a direction away from the opening and the through hole for the guide surface to be pushed by the connecting end of the fan blade; wherein when the guide surface of the elastic member is pushed by the fan blade, the holding portion is moved away from the space; wherein when the fan blade is connected to the socket, the holding portion passes through the through hole and is engaged in the blade hole so that the fan blade is secured to the socket; wherein when the user operates the operating portion to move away from the space, the holding portion is moved away from the space, wherein the ceiling fan further has at least one bracket, at least one base and a motor, the motor has a rotor, the rotor is fixedly connected to the at least one bracket, and the at least one base is fixed below the at least one bracket so that the at least one socket is formed between the at least one base and the at least one bracket, wherein the elastic member further has a spring, a holding member and a shaft, the spring has the closed end and the open end, the base, the spring and the holding member are pivotally connected to the shaft, the closed end of the elastic member is fixed below the base, the holding member is disposed on one side of the open end of the elastic member adjacent to the through hole so that the open end of the elastic member leans against the holding member, the holding member has the holding portion extending toward the space, and the holding member extends downward and outward to form the operating portion.

2. The fan blade installation structure of the ceiling fan as claimed in claim 1, wherein the through hole is disposed at a bottom of the base, and the closed end of the elastic member is fixedly disposed below the base.

3. The fan blade installation structure of the ceiling fan as claimed in claim 2, wherein the guide surface is one of a curved surface and an oblique surface.

4. The fan blade installation structure of the ceiling fan as claimed in claim 1, wherein the operating portion has a flange.

5. The fan blade installation structure of the ceiling fan as claimed in claim 1, wherein the spring is a torsion spring.

* * * * *